US009825376B2

(12) United States Patent
Kudo

(10) Patent No.: US 9,825,376 B2
(45) Date of Patent: Nov. 21, 2017

(54) PRESSURE WELDING CONTACT HAVING A BELLOWS TYPE TERMINAL AND PRESSURE WELDING CONNECTOR

(71) Applicant: J.S.T. Mfg. Co., Ltd., Osaka-shi (JP)

(72) Inventor: Hironori Kudo, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/465,898

(22) Filed: Mar. 22, 2017

(65) Prior Publication Data

US 2017/0279204 A1 Sep. 28, 2017

(30) Foreign Application Priority Data

Mar. 25, 2016 (JP) ..... 2016-061131

(51) Int. Cl.
*H01R 4/24* (2006.01)
*H01R 13/11* (2006.01)

(52) U.S. Cl.
CPC ..... *H01R 4/2425* (2013.01); *H01R 13/114* (2013.01)

(58) Field of Classification Search
CPC ..... H01R 4/2425; H01R 13/114
USPC ..... 439/395
See application file for complete search history.

(56) References Cited

U.S. PATENT DOCUMENTS 4,566,749 A * 1/1986 Johnston ..... H01R 24/62 439/425
4,759,726 A * 7/1988 Naylor ..... H01R 4/5008 439/441
4,768,981 A * 9/1988 Hohorst ..... H01R 4/4845 439/828
5,061,203 A * 10/1991 Allgood ..... H01R 4/2454 439/404
5,626,488 A * 5/1997 Albeck ..... H01R 4/2429 439/395
5,810,625 A * 9/1998 Klein ..... H01R 4/4827 439/441
5,876,237 A * 3/1999 Patel ..... H01R 4/4827 439/441

(Continued)

FOREIGN PATENT DOCUMENTS

JP 2000-067988 A 3/2000
JP 2005-294217 A 10/2005

*Primary Examiner* — Alexander Gilman
(74) *Attorney, Agent, or Firm* — Kratz, Quintos & Hanson, LLP

(57) ABSTRACT

The pressure welding contact is provided with an electric wire connecting portion and a contact connecting portion. The electric wire connecting portion comprises a first fixing plate and a pressure welding piece. The pressure welding piece comprises a notched groove into which the core wire of the electric wire can be introduced. The contact connecting portion comprises a second fixing plate and an elastic piece. The second fixing plate contacts the first fixing plate. The elastic piece turns back from the base end portion of the second fixing plate. Further, the elastic piece is disposed in a state inclined upwards, towards the tip portion of the second fixing plate. The elastic piece comprises at its tip portion a contact point portion. The mating side connector can be inserted from between the second fixing plate and the elastic piece.

7 Claims, 14 Drawing Sheets

(56) References Cited

U.S. PATENT DOCUMENTS 5,975,940 A * 11/1999 Hartmann ..... H01R 4/4818 439/441
6,250,950 B1 * 6/2001 Pallai ..... H01R 4/4836 439/439
6,261,120 B1 * 7/2001 Beege ..... H01R 4/4836 439/268
D500,742 S * 1/2005 Stadler ..... D13/147
7,329,143 B2 * 2/2008 Schrader ..... H01R 4/4827 439/441
8,062,077 B2 * 11/2011 Hayashi ..... H01R 4/4863 439/725
8,210,865 B2 * 7/2012 Hayashi ..... H01R 4/4836 439/409
8,398,430 B1 * 3/2013 Queru ..... H01R 31/06 439/536
8,444,443 B2 * 5/2013 Schafmeister ..... H01R 4/4836 439/441
8,512,068 B2 * 8/2013 Gassauer ..... H01R 4/4818 439/411
9,252,520 B1 * 2/2016 Weiden ..... H01R 4/4845
9,337,556 B2 * 5/2016 Rask ..... F04D 13/0686
9,437,940 B1 * 9/2016 Rao ..... H01R 4/4836
9,543,700 B2 * 1/2017 Kollmann ..... H01R 4/4836
2004/0217831 A1 * 11/2004 Bauer ..... H01H 11/0031 335/202
2005/0221658 A1 10/2005 Hiramoto
2007/0082551 A1 * 4/2007 Oesterhaus ..... H01R 4/4827 439/607.01
2009/0253306 A1 * 10/2009 Knoerrchen ..... H01R 4/4836 439/651
2013/0065427 A1 * 3/2013 Fleischmann ..... H01R 13/5829 439/465
2015/0017833 A1 * 1/2015 Sato ..... H01R 4/184 439/519
2015/0079857 A1 * 3/2015 Kawamura ..... H01R 43/0482 439/877

* cited by examiner

PRESSURE WELDING CONTACT HAVING A BELLOWS TYPE TERMINAL AND PRESSURE WELDING CONNECTOR

This application is based on and claims the benefit of priority from Japanese Patent Application No. 2016-061131, filed on 25 Mar. 2016, the content of which is incorporated herein by reference.

BACKGROUND OF THE INVENTION

Field of the Invention

The present invention relates to a pressure welding contact and a pressure welding connector. In particular, it relates to a pressure welding contact for pressure weld-connecting a terminal of an electric wire, and to the structure of a pressure welding connector provided with this pressure welding contact.

Related Art

In order to electrically and mechanically detachably connect wires to wires, or wires to printed circuit boards, electric connectors are widely used. Electric connectors for electric wires are provided with contacts where the terminals of electric wires are hard wired by crimping or pressure welding.

Pressure welding connections can electrically connect a core wire and a contact upon insertion of a terminal of a wire (an insulating covered wire) from an outer circumferential direction into a slot formed in a contact, by both side faces of the slot cutting into the insulation covering. In pressure welding connections, the insulation covering of the terminal of the electric wire is detached and the like, and this can shorten the processing time required for hard wiring because a termination treatment for crimping connections is unnecessary. Further, pressure welding connections, compared to crimping connections, have the advantage of not being readily influenced by the technique of the operator.

As such a pressure welding connector provided with a pressure welding contact, for example, the disclosure of Japanese Unexamined Patent Application, First Publication No. 2000-67988 (below referred to as Patent Document 1) may be mentioned. Patent Document 1 discloses a pressure welding connector which due to an overhanging flange-shaped projecting piece along a bottom back end of a housing, can be easily held by fingers, and has good assembly workability.

Further, for example, the disclosure of Japanese Unexamined Patent Application, First Publication No. 2005-294217 (below referred to as Patent Document 2) may be mentioned. Patent Document 2 discloses a pressure welding contact which can ensure a resilient pressure welding state with a mating connectors even when the size is small, and an electrical connector using the same.

In Patent Document 1, the pressure welding connector has, in its inner portion, a plurality of pressure welded contacts hard wired by pressure welding the terminals of respective electric wires. The pressure welding connector can connect with the pin contacts of a mating connector. The contact attachment portion in the pressure welding contact is constituted of a pair of clamped pieces. The pin contact is inserted between the pair of clamped pieces, from a direction orthogonal to the direction of opening and closing the tip portions of the pair of clamped pieces.

According to the above constitution, when the pin contact is inserted between the pair of clamped pieces, it is necessary to insert the pin contact against the bending stress in the opening and closing direction of the pair of clamped pieces.

For the pressure welding connector, from the viewpoint of high density mounting, the width (height) of the housing of the pressure welding connector is made small. Therefore, the distance from the fixed ends of the clamped pieces to the point of contact with the pin contact is necessarily made short, and the insertion and extraction force of the pin contact is generally large. As the number of poles of the contact becomes large, the above mentioned insertion and extraction force becomes great, and it not easy to attach and detach the pressure welding connector and the mating connector.

In Patent Document 2, the pressure welding connector having in its inner portion a plurality of pressure welding contacts hard wired by pressure welding of the terminals of the respective electric wires can be connected with a blade contact of the mating connector. The contact portion of the contact in the pressure welding contact is constituted by a pair of clamped pieces. The contact connecting piece of the blade contact is inserted between the pair of clamped pieces from a direction orthogonal to the direction of the opening and closing of the tip portions of the pair of clamped pieces.

According to the above constitution, when it is attempted to insert the contact connecting piece between the pair of clamped pieces, it is necessary to insert the contact connecting piece against the bending stress in the opening and closing direction of the pair of clamped pieces.

In Patent Document 2, in the same way as Patent Document 1, for the pressure welding connector, from the viewpoint of high density mounting, the height of the housing of the pressure welding connector is made small. Therefore, the distance from the fixed ends of the clamped pieces to the point of contact with the pin contact is necessarily made short, and the insertion and extraction force of the pin contact is generally large. As the number of poles of the contact becomes large, the above mentioned insertion and extraction force becomes great, and it not easy to attach and detach the pressure welding connector and the mating connector.

Generally, a pressure welding contact (simply referred to as "contact") is produced by press molding a metal plate which has been expanded after punch die processing. Such contacts are produced by press molding a plurality in one batch. Such contacts are joined by a continuous strip-shaped contact carrier, and continuously press molded.

The contacts in a state joined on the contact carrier are referred to as concatenated contacts. The concatenated contacts wound on a reel are taken out, and continuously joined with an electric wire by an automatic crimping device or the like.

Such contacts, in a state of a developed plate having undergone punching processing, the pair of clamped pieces are disposed approximately parallel to a direction of extension of the contact carrier.

Namely, in the case that the contact is produced as concatenated contacts, the pitch of the concatenated contacts, without becoming shorter due to the size of the pair of clamped pieces, and there is a substantial difference from the pitch of fixing the pressure welding contacts to the housing.

The present invention has the objective of providing a pressure welding contact and a pressure welding connector wherein the mating contacts and mating connectors are easily attached and detached, and which make it possible to make short the pitch of the concatenated contacts.

SUMMARY OF THE INVENTION

The present inventor, in order to satisfy the above described objective, discovered that in a pressure welding contact provided with an electric wire connecting portion which can be pressure welding-connected with a terminal of an electric wire, and a contact connecting portion which can be installed at the mating contact, the contact joining portion is constituted by a strip-shaped bellows terminal, and based on this, invented the below described novel pressure welding contact and pressure welding connector.

The first aspect of the present invention is a pressure welding contact provided with an electric wire connecting portion for hard wiring by a pressure welding connection a terminal of an electric wire, and a contact connecting portion which is capable of connecting with a mating side contact, wherein the electric wire connecting portion comprises a strip-shaped first fixing plate on which the terminal of the electric wire can be mounted, and a pressure welding piece continuous from a base end portion of the first fixing plate and rising from one face of the first fixing plate, and having a notched groove, into which a core wire of the electric wire can be introduced from an outer circumferential direction, notched towards the one face of the first fixing plate, the contact connecting portion comprises a strip-shaped second fixing plate which, in a state contacting another face of the first fixing plate from a tip portion of the first fixing plate, extends towards the pressure welding piece, and an elastic piece which is continuous from a base end portion of the second fixing plate, and which turns back towards another face of the second fixing plate from one face of the second fixing plate, and which is provided with a tip portion including a contact point portion in a state which inclines upwards in a direction away from the other face of the second fixing plate towards a tip portion of the second fixing plate, and wherein the pressure welding contact is maintained in a first housing with a hole opened in one end face, into which the mating side contact is insertable from between the tip portion of the second fixing plate and the tip portion of the elastic piece, towards the base end portion of the elastic piece.

The second aspect of the present invention is a pressure welding contact according to the first aspect, wherein the pressure welding piece is provided above the second fixing plate between the base end portion and the tip portion of the second fixing plate, and in a perpendicular direction with respect to the one face of the first fixing plate.

The third aspect of the present invention is a pressure welding contact according to the first or second aspect, wherein the pressure welding piece is joined by a notch which is easily separated from a tip edge thereof, to a side portion of a strip-shaped contact carrier, and this contact carrier, is joined to the pressure welding piece in a direction approximately perpendicular with respect to the direction in which the contact carrier extends.

The fourth aspect of the present invention is a pressure welding connector provided with a rectangular solid-shaped first housing inside which one or more of the pressure welding contacts according to any one of the first to third aspects are disposed, wherein the first housing comprises a first slot capable of accommodating the pressure welding contact hollowed out from one face of the first housing, where the elastic piece can be disposed to face a bottom face of the first slot, a second slot which communicates with the first slot, into which the terminal of the electric wire can be introduced from an outer circumferential direction in an insulating covered state, and one or more holes, opened on one end face adjoining the one face of the first housing, into which the mating side contact can be inserted towards a space between the tip portion of the second fixing plate and the tip portion of the elastic piece.

The fifth aspect of the present invention is a pressure welding connector according to the fourth aspect, wherein the mating side connector consists of a pin-shaped connecting terminal, and the mating side connector is provided with a rectangular solid-shaped second housing where one or more of the connecting terminals are disposed inside a recess portion opened at one face, the first housing comprises a header portion which is fittable in the recess portion, formed at one end side, and a flange portion which is partially abuttable with one face of the second housing, formed at another end portion, the second housing comprises a strip-shaped lock arm which is provided at a prescribed space from one inner wall of the recess portion and which projects from a bottom portion of the recess portion towards the open face of the recess portion and approximately parallel to the one inner wall of the recess portion, the lock arm being provided at its tip portion with a trapezoidal-shaped hook portion projecting towards a central portion of the recess portion, and the first housing comprises one or more quadrangular frustum-shaped engaging protrusions which are capable of engaging and disengaging with the hook portion, protruding from one face of the header portion.

The sixth aspect of the present invention is a pressure welding connector according to the fifth aspect, wherein the mating side connector comprises a lead terminal continuous with the connecting terminal, which can be solder-joined to a printed circuit board.

The seventh aspect of the present invention is a pressure welding connector according to the sixth aspect, wherein at the mating side connector, the lead terminal is bent at an approximately right angle with respect to the connecting terminal.

BRIEF DESCRIPTION OF THE DRAWINGS

FIG. 11A is a plan view showing a state in which the pressure welding connector and the mating side connector are connected, FIG. 11B is a front view of FIG. 11A, FIG. 11C is a back view of FIG. 11A, FIG. 11D is a right side view of FIG. 11A, FIG. 11E is a left side view of FIG. 11A, and FIG. 11F is a bottom view of FIG. 11A.

DETAILED DESCRIPTION OF THE INVENTION

Hereinafter, modes for carrying out the present invention will be described with reference to the drawings.

[Constitution of the Pressure Welding Contact]

First, the constitution of the pressure welding contact according to one embodiment of the present invention will be explained.

Figure 1:
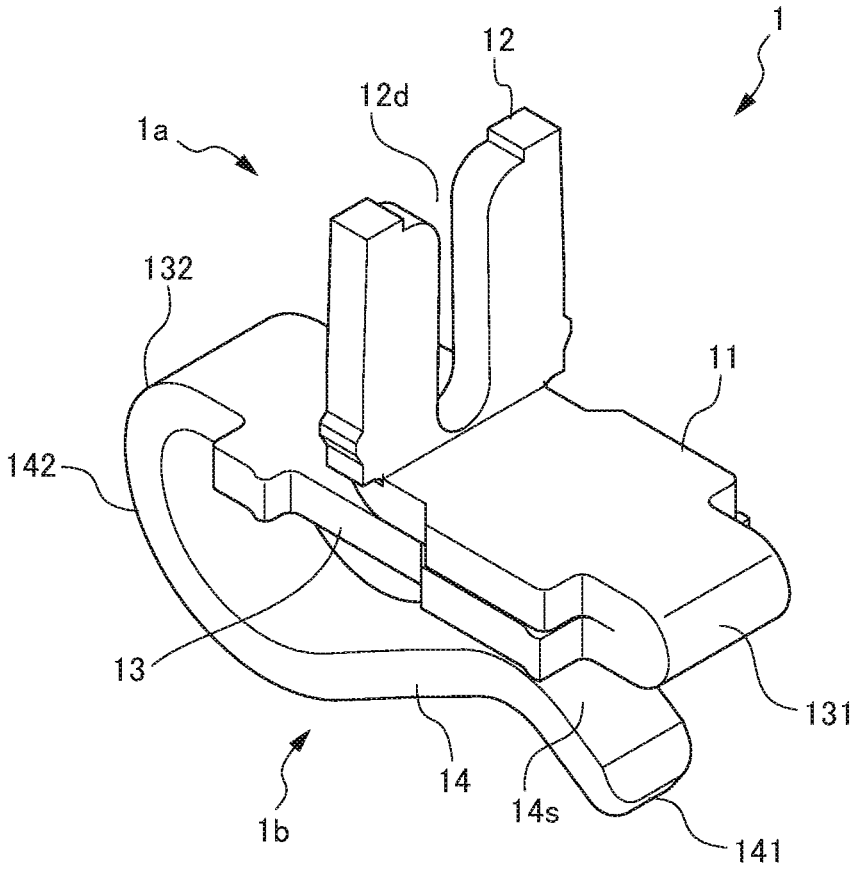
FIG. 1 is an oblique view showing the constitution of the pressure welding contact according to one embodiment of the present invention.

FIG. 1 is an oblique view showing the constitution of the pressure welding contact according to one embodiment of the present invention.

Figure 2:
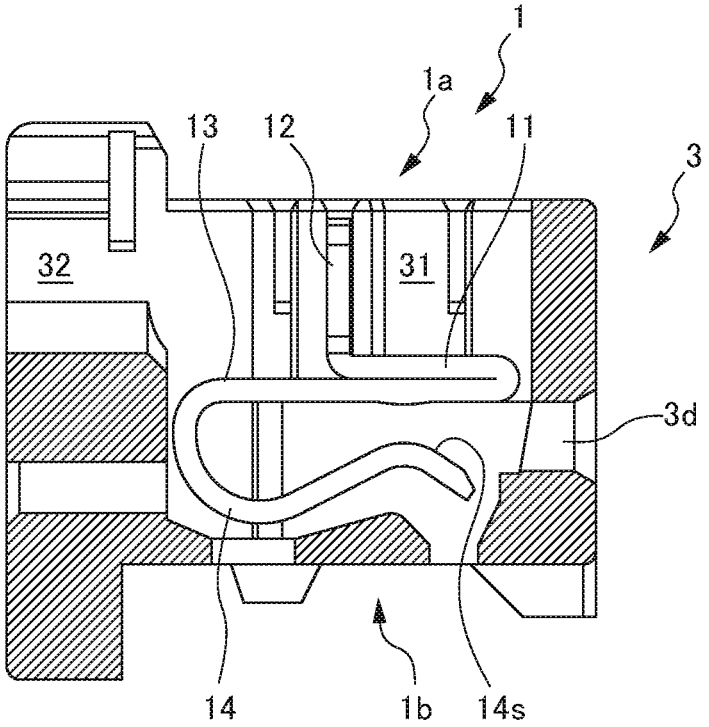
FIG. 2 is a right side face view showing the constitution of the pressure welding contact according to the above described embodiment, and shows a state in which the pressure welding contact is mounted inside the first housing.

FIG. 2 is a right side face view showing the constitution of the pressure welding contact according to the above described embodiment, and shows a state in which the pressure welding contact is mounted inside the first housing.

Figure 3:
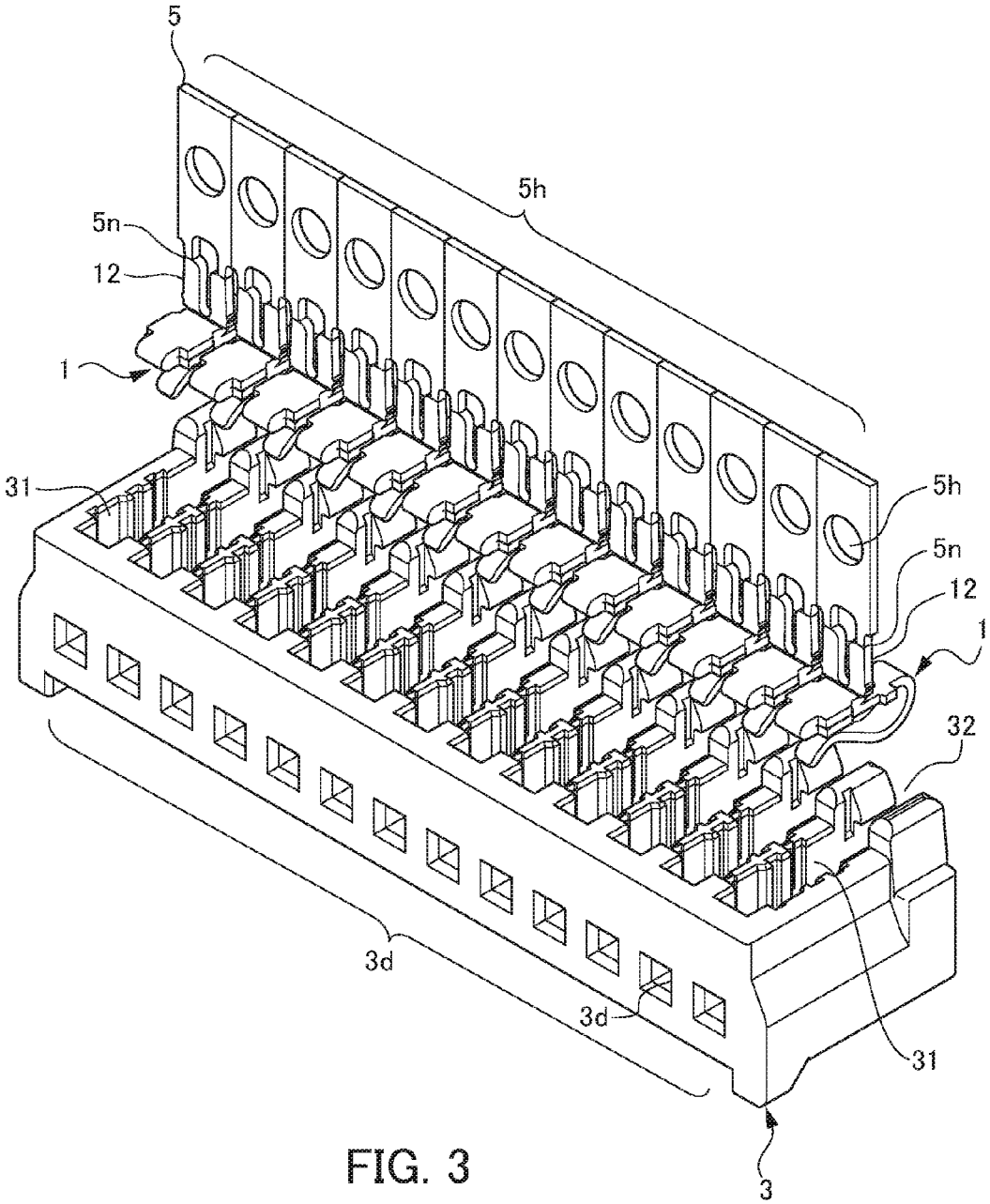
FIG. 3 is an oblique view of the contact carrier on which the pressure welding contacts are consecutively provided according to the above described embodiment, and shows a state before the pressure welding contacts are mounted on the first housing disposed facing the contact carrier.

FIG. 3 is an oblique view of the contact carrier on which the pressure welding contacts are consecutively provided according to the above described embodiment, and shows a state before the pressure welding contacts are mounted on the first housing disposed facing the contact carrier.

Figure 4:
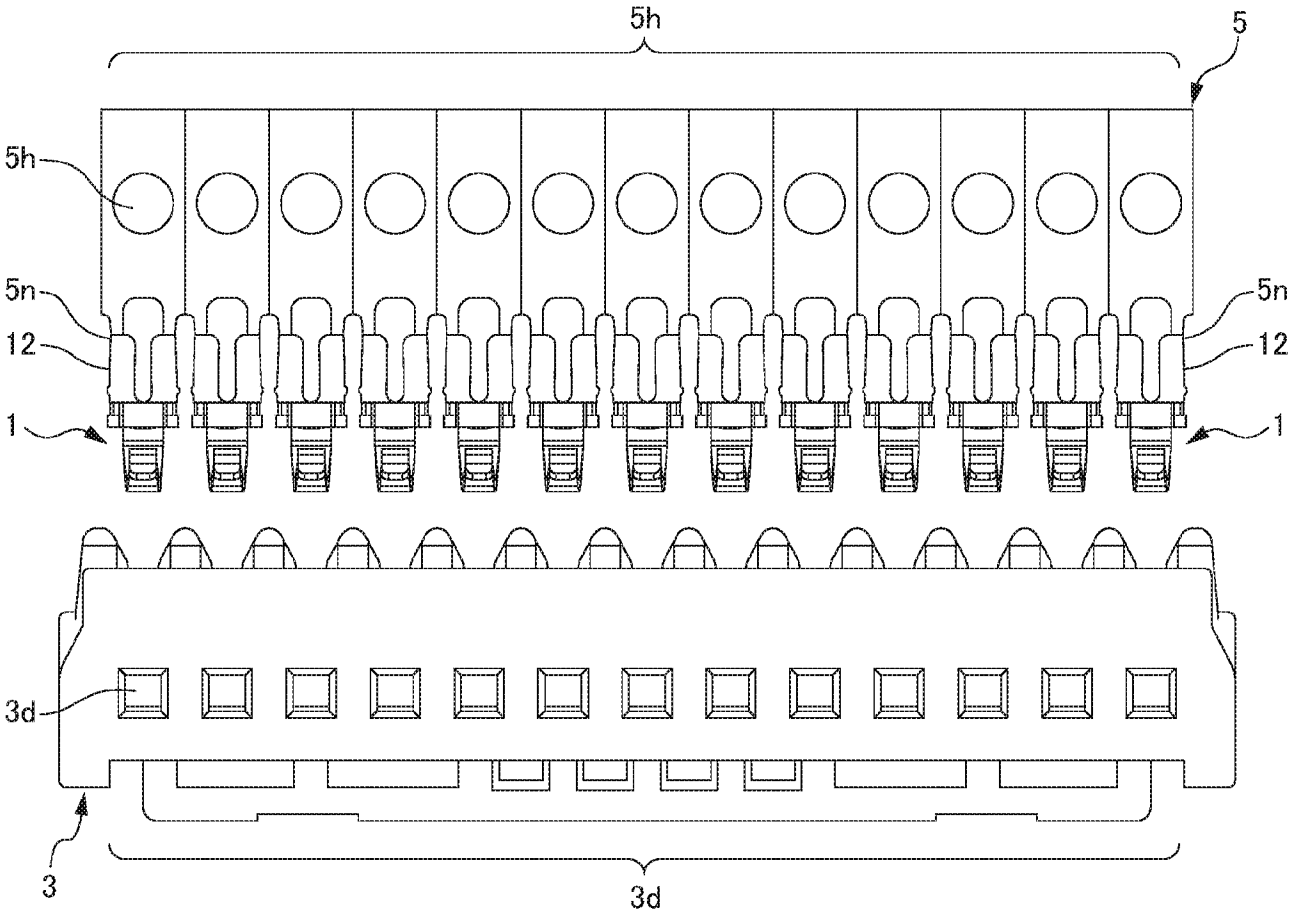
FIG. 4 is a frontal view of the contact carrier on which the pressure welding contacts are consecutively provided according to the above described embodiment, and shows a state before pressure welding contact is mounted on the first housing disposed facing the contact carrier.

FIG. 4 is a frontal view of the contact carrier on which the pressure welding contacts are consecutively provided according to the above described embodiment, and shows a state before pressure welding contact is mounted on the first housing disposed facing the contact carrier.

Figure 5:
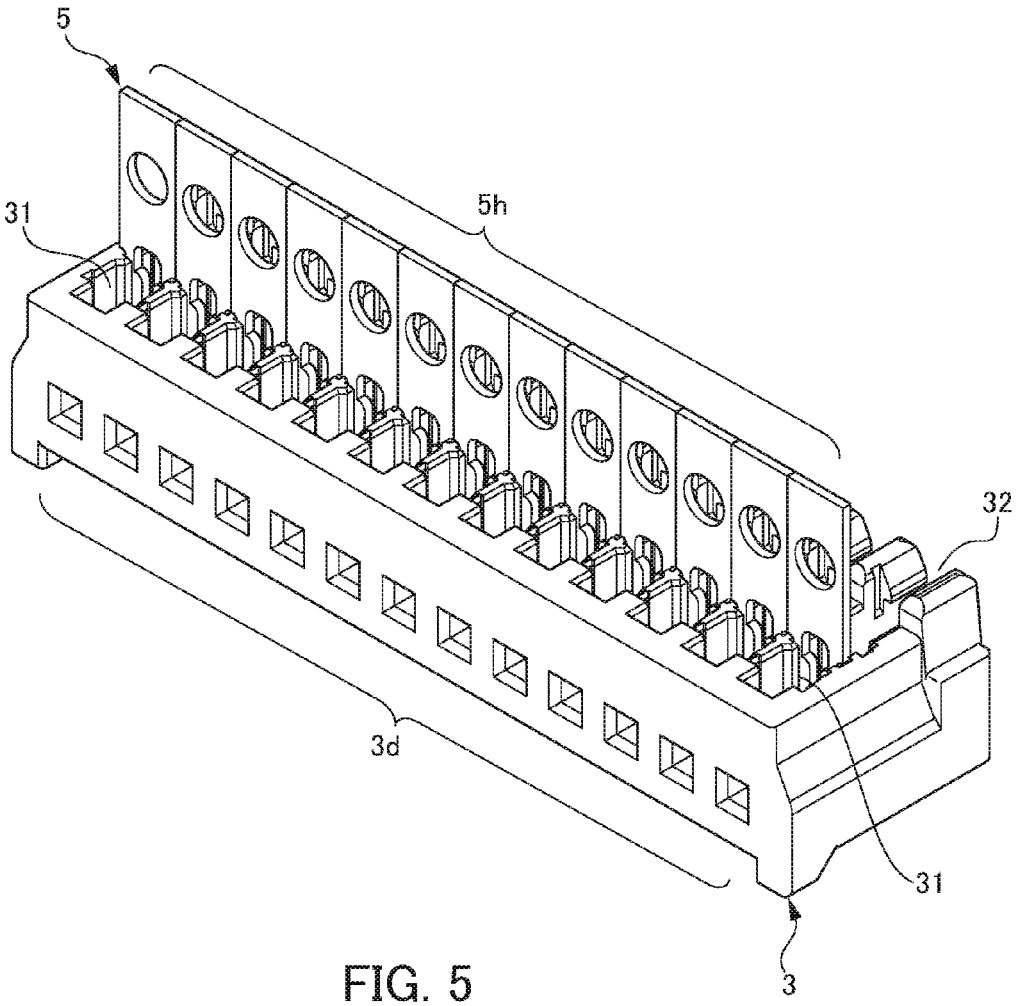
FIG. 5 is an oblique view of the contact carrier on which the pressure welding contacts are consecutively provided according to the above described embodiment, and shows a state in which the pressure welding contacts are mounted on the first housing disposed facing the contact carrier.
Figure 6:
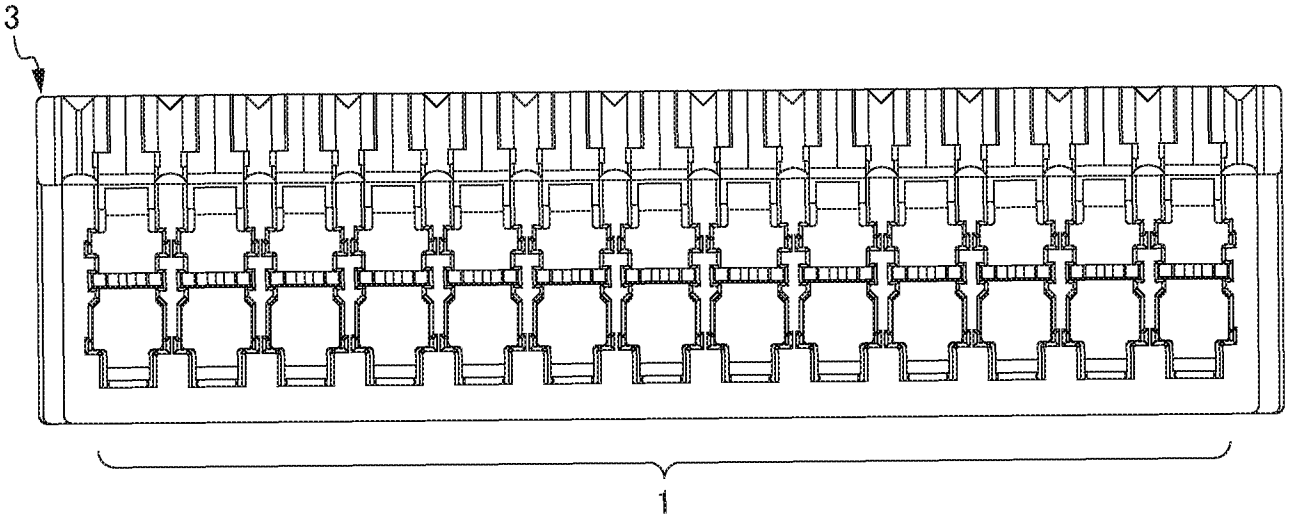
FIG. 6 is a plan view showing the constitution of the pressure welding contact according to the above described embodiment, and shows a state in which the joining with the contact carrier is detached, and the pressure welding contact is mounted on the first housing.

FIG. 5 is an oblique view of the contact carrier on which the pressure welding contacts are consecutively provided according to the above described embodiment, and shows a state in which the pressure welding contacts are mounted on the first housing disposed facing the contact carrier.

With reference to FIG. 1 and FIG. 2, the pressure welding contact 1 according to one embodiment of the present invention is provided with an electric wire connecting portion 1*a* and a contact connecting portion 1*b*. The electric wire connecting portion 1*a* can hard wire the terminal of the electric wire W by a pressure welding connection (refer to FIG. 8 or FIG. 13 and FIG. 14). The contact connecting portion 1*b* can connect with the mating side contact (below referred to as "pin contact") 2 (refer to FIG. 13 or FIG. 14). The electric wire W may also mean an insulating covered.

With reference to FIG. 1 and FIG. 2, the electric wire connecting portion 1*a* has a strip-shaped first fixing plate 11 and a pressure welding piece 12. The strip-shaped first fixing plate 11 can have mounted on one face, from an outer circumferential direction thereof, the terminal of the electric wire W. The pressure welding piece 12 is continuous from the base end portion of the first fixing plate 11 and rises from one face of the first fixing plate 11. The pressure welding piece 12 has a base end portion where one face of the first fixing plate 11 is bent perpendicularly. Further, the pressure welding piece 12 has a notched groove 12*d* into which the core wire of the electric wire W can be introduced from an outer circumferential direction. The notched groove 12*d* is notched towards one face of the first fixing plate 11.

With reference to FIG. 1 and FIG. 2, the contact connecting portion 1*b* has a strip-shaped second fixing plate 13 and an elastic piece 14, and constitutes a strip-shaped bellows terminal. For the second fixing plate 13, from the tip portion of the first fixing plate 11, one face of the second fixing plate 13 contacts the other face of the first fixing plate 11. The second fixing plate 13 has a tip portion 131 where the one face of the first fixing plate 11 is folded back to the other face side. Thus, the second fixing plate 13 extends towards the pressure welding piece 12. The pressure welding piece 12 is provided above the second fixing plate 13 between the base end portion 132 and the tip portion 131 of the second fixing plate 13, and in a perpendicular direction with respect to one face of the first fixing plate 11.

With reference to FIG. 1 and FIG. 2, the elastic piece 14 is constituted to be continuous with the base end portion 132 of the second fixing plate 13, and to turn back towards the other face of the second fixing plate 13 from the one face of the second fixing plate 13. Further, the elastic piece 14 is disposed in a state such that towards the tip portion 131 of the second fixing plate 13, it approaches the other face of the second fixing plate 13, and then the tip portion 141 of the elastic piece 14 inclines upwards in a direction away from the other face of the second fixing plate 13.

With reference to FIG. 1 and FIG. 2, the elastic piece 14 has at its tip portion a contact point portion 14*s*. The contact point portion 14*s* is disposed facing the other face of the second fixing plate 13, and with a prescribed gap provided therebetween. The pint contact 2 can be inserted from between the tip portion 131 of the second fixing plate 13 and the tip portion 141 of the elastic piece 14, towards the base end portion 142 of the elastic piece 14 (refer to FIG. 13 and FIG. 14).

With reference to FIG. 2, the pressure welding contact 1 according to the embodiment is retained in the first housing 3. One end face of the first housing 3 has a hole 3*d* opened therein (refer to FIG. 3). Upon inserting the pin contact 2, which is a mating side contact, into the hole 3*d*, it can be connected with the contact connecting portion 1*b* (refer to FIG. 14).

With reference to FIG. 1 and FIG. 2, the pressure welding contact 1 according to the embodiment has an elastic piece 14 which turns back towards the other face of the second fixing plate 13 from the one face of the second fixing plate 13, and which, towards the tip portion 131 of the second fixing plate 13, inclines upwards in a direction away from the other face of the second fixing plate 13. The elastic piece 14 has at its tip portion the contact point portion 14*s* disposed facing the other face of the second fixing plate 13, therefore, the insertion and extraction force of the mating side contact inserted from between the tip portion 131 of the second fixing portion 13 and the tip portion 141 of the elastic piece 14 towards the base end portion 142 of the elastic piece 14 can be reduced.

(Constitution of the Contact Carrier)

Next, the constitution of the contact carrier according to one embodiment of the present invention will be explained. With reference to FIG. 3 to FIG. 5, the contact carrier 5 according to one embodiment of the present invention consists of a strip-shaped metal plate having conductivity, and is connected at one side with a plurality of pressure welding contacts 1.

With reference to FIG. 3 to FIG. 5, the contact carrier 5 is a side feed single carrier whereby a single end portion in the lengthwise direction of the concatenated contacts are joined with the contact carrier. The contact carrier 5 is joined with the tip edges of the pressure welding pieces 12 such that lengthwise direction of the contact carrier 5 and the lengthwise direction of the concatenated pressure welding contacts 1 are approximately perpendicular. Namely, for the contact carrier 5, the pressure welding pieces 12 are joined in a direction approximately perpendicular with respect to the direction in which the contact carrier 5 extends.

With reference to FIG. 3 to FIG. 5, at the boundary of the contact carrier 5 and the pressure welding contact 1, a V-shaped notch (indentation) 5*n* is formed. The pressure welding contact 1 can be detached from the contact carrier 5 by the notch 5*n*, and it is also possible to take the pressure welding contacts 1 as individual contact parts.

With reference to FIG. 3 to FIG. 5, at the contact carrier 5, in order to mold the pressure welding contacts 1, the location holes 5*h* for aligning the mold are provided corresponding to the pressure welding contacts 1. Using these alignment holes 5*h*, a contact carrier 5 furnished with a plurality of pressure welding contacts 1 can be accurately conveyed.

[Operation of the Pressure Welding Contact]

Next, the operation and effects of the pressure welding contact 1 according to the embodiment will be explained. With reference to FIG. 1 and FIG. 2, the pressure welding contact 1 can be obtained in the desired form by punch-processing a conductive metal plate. For the pressure welding contact 1, in consideration of the ease of processing, spring characteristics, conductivity and the like, for example, a copper alloy is preferably used, but it is not limited to copper alloys.

With reference to FIG. 1 and FIG. 2, the pressure welding contact 1 according to the embodiment has an elastic piece 14 which is disposed in a state such that it turns back from the base end portion 132 of the second fixing plate 13, and the tip portion is inclined upwards towards the tip portion 131 of the second fixing plate 13. The elastic piece 14 has at its tip portion a contact point portion 14*s* disposed facing the other face of the second fixing plate 13. In this way, the mating side contact can be inserted from between the tip portion 131 of the second fixing plate 13 and the tip portion 141 of the elastic piece 14 towards the base end portion 142 of the elastic piece 14. Accordingly, such a pressure welding contact 1 can reduce the insertion and extraction force of the mating side contact.

(Operation of the Contact Carrier)

Next, while explaining the action of the contact carrier 5 according to the embodiment, the operation and effects of the contact carrier 5 will be explained. With reference to FIG. 3, the contact carrier 5 can convey the pressure welding contact 1 to above the first slot 31 cut into one face of the first housing 3.

Next, from the state shown in FIG. 3 and FIG. 4, using an automatic insertion mechanism (not shown in the drawings) or the like, the plurality of pressure welding contacts 1 are consolidated, and inserted into the first slot 31 (refer to FIG. 5). Next, by tilting the contact carrier 5 with respect to the pressure welding contacts 1, the plurality of pressure welding contacts 1 are consolidated, and separated from the contact carrier 5, and the plurality of pressure welding contacts 1 are consolidated, and can be mounted on the first housing 3 (refer to FIG. 2 to FIG. 6).

The contact carrier 5 according to the embodiment is joined with the tip edges of the pressure welding pieces 12 by the notches which are easily separated from the tip edges of the pressure welding pieces 12, and the pressure welding pieces 12 are joined in a direction approximately perpendicular with respect to the direction in which the contact carrier 5 extends, and therefore, it is possible to make the contact pitch of consecutively providing on the contact carrier the same as the pitch of the first slots 31 consecutively provided on the first housing 3.

In this way, by implementing a pressure welding contact where the pitch of the concatenated contacts and the pitch of attaching to the housing coincide, the assembly of the contacts to the housing becomes easy, and the productivity can be increased. Further, the pitch of the concatenated contacts can be made short compared to the prior art, and therefore, the number of contacts can be made large with respect to the unit length of the contact carrier, and this contributes to saving resources.

[Constitution of the Pressure Welding Connector]

Next, the pressure welding connector according to one embodiment of the present invention will be explained.

Figure 7:
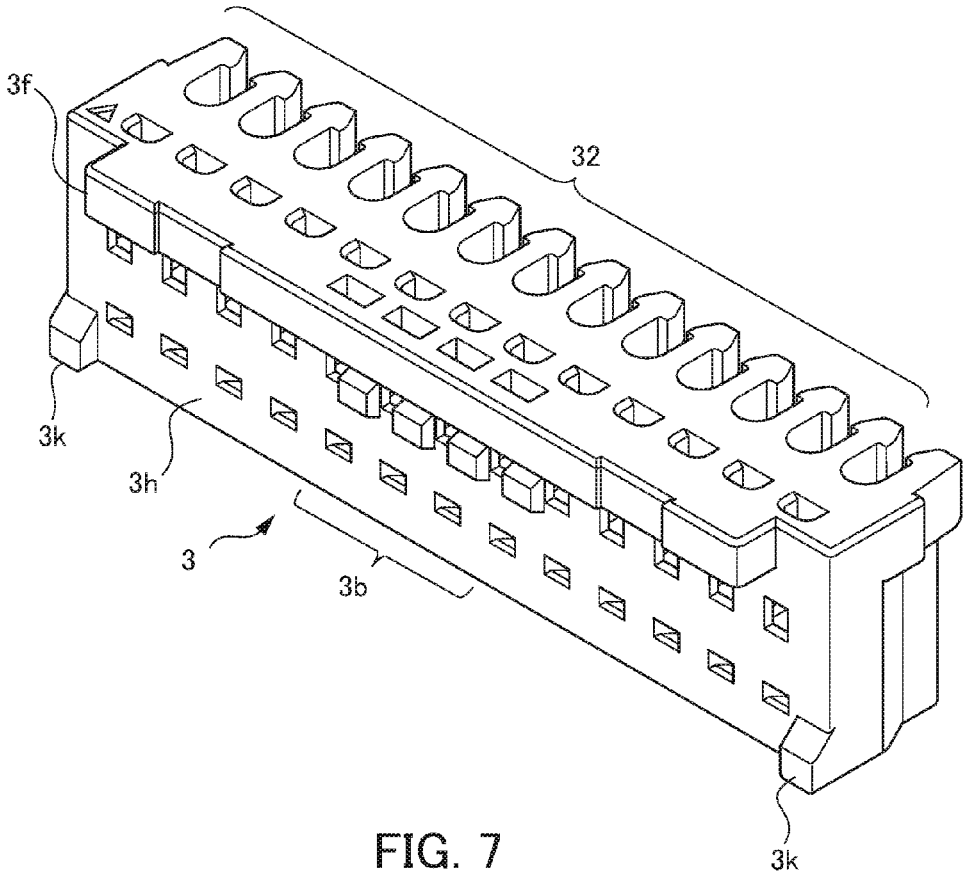
FIG. 7 is an oblique view showing the constitution of the first housing provided at the pressure welding connectors according to one embodiment of the present invention.
Figure 8:
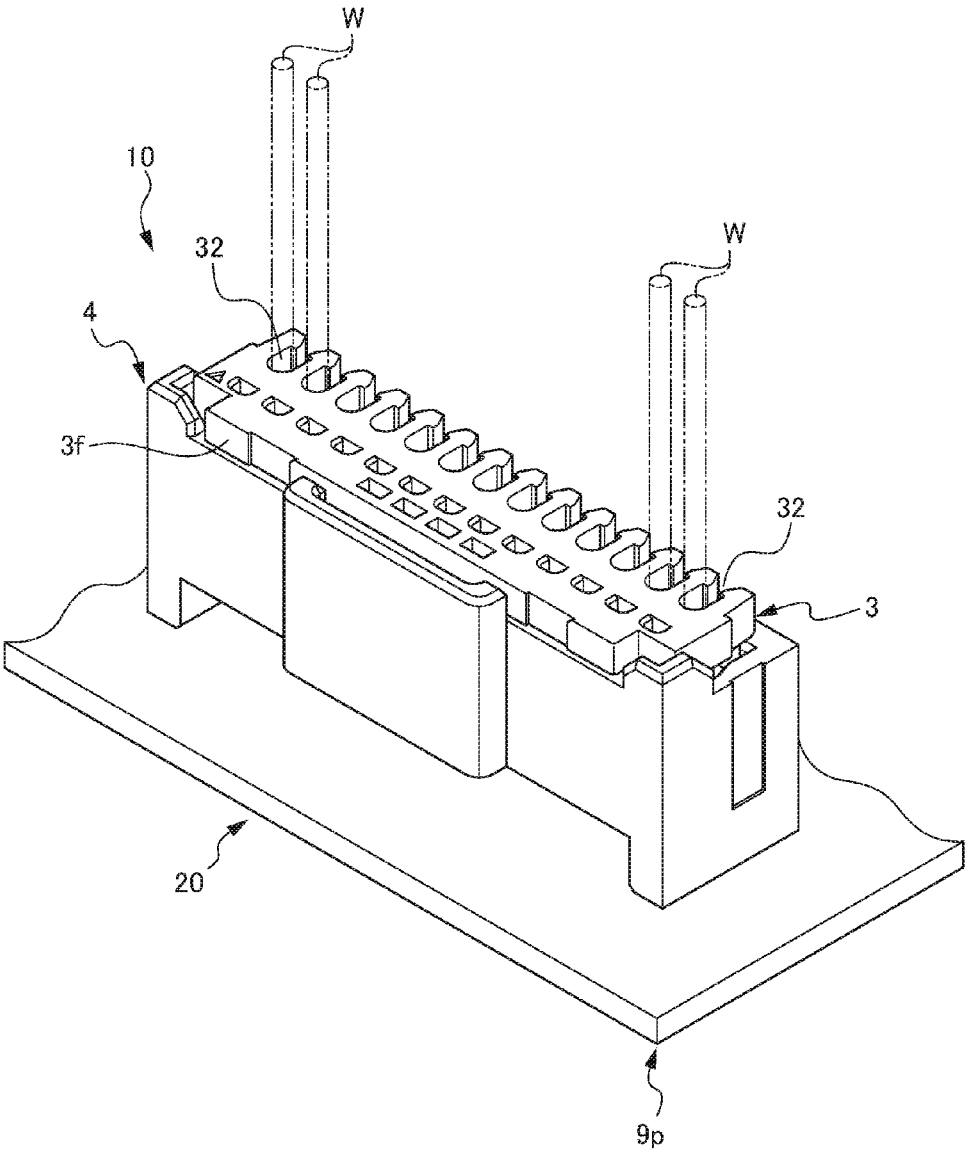
FIG. 8 is an oblique view showing the constitution of the pressure welding connector according to the above described embodiment, and shows a state in which the pressure welding connector and the mating side connector are connected.

FIG. 7 is an oblique view showing the constitution of the first housing provided at the pressure welding connector according to one embodiment of the present invention. FIG. 8 is an oblique view showing the constitution of the pressure welding connector according to the above described embodiment, and shows a state in which the pressure welding connector and the mating side connector are connected.

Figure 9:
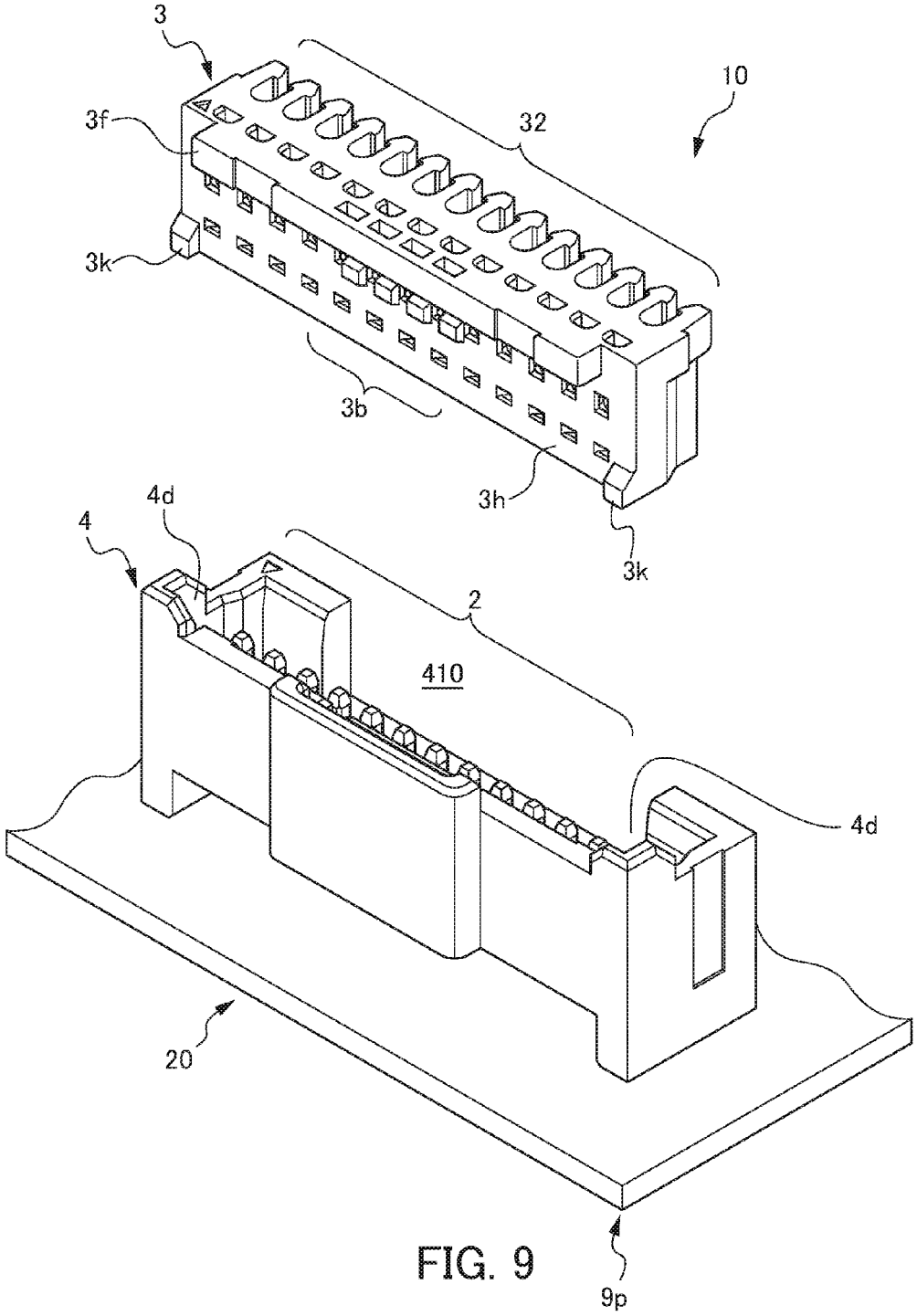
FIG. 9 is an oblique view showing the constitution of the pressure welding connector according to the above described embodiment, and shows a state in which the pressure welding connector and the mating side connector are disposed facing each other.
Figure 10:
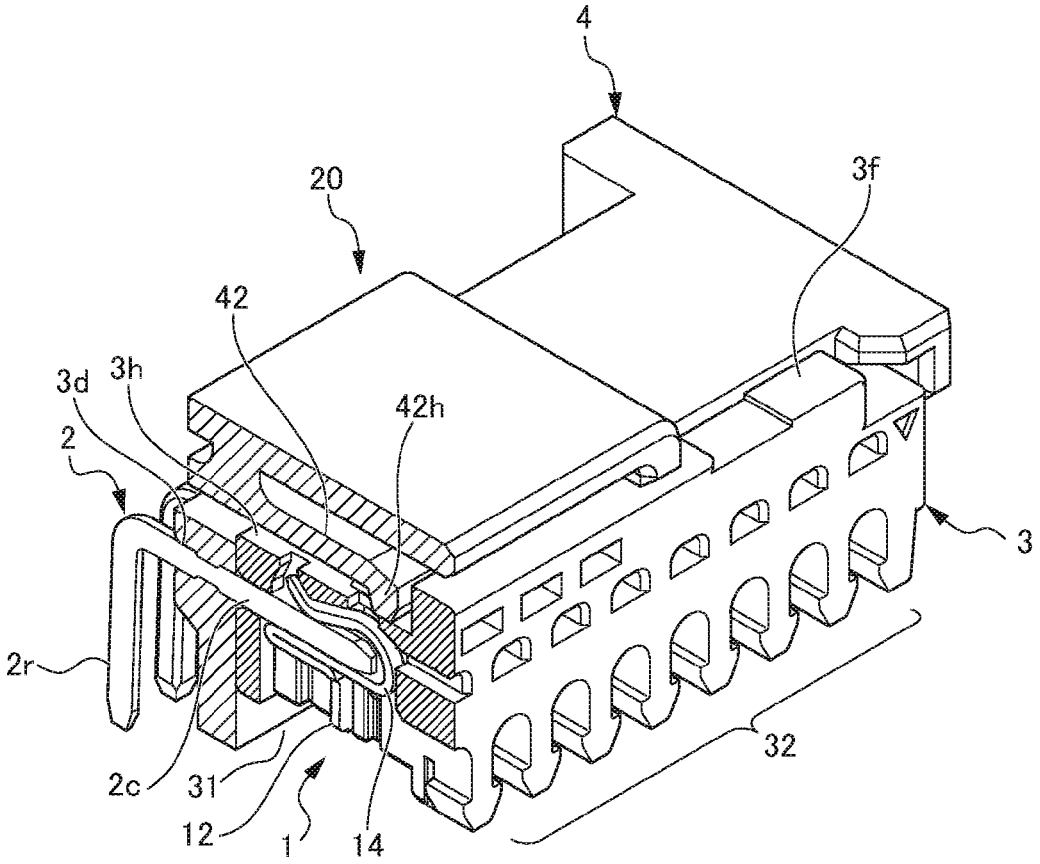
FIG. 10 is an oblique cross sectional view showing the constitution of the connector according to the above described embodiment, and shows a state in which the pressure welding connector and the mating side connector are connected.

FIG. 9 is an oblique view showing the constitution of the pressure welding connector according to the above described embodiment, and shows a state in which the pressure welding connector and the mating side connector are disposed facing each other. FIG. 10 is an oblique cross sectional view showing the constitution of the connector according to the above described embodiment, and shows a state in which the pressure welding connector and the mating side connector are connected.

Figure 11C:
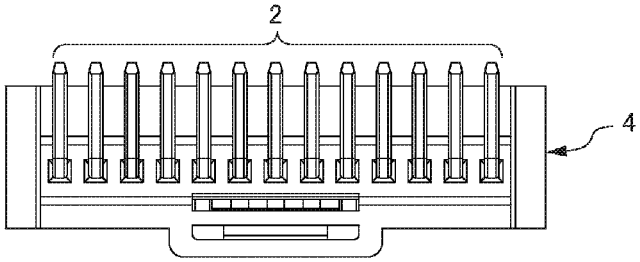
FIGS. 11A to 11F are drawings showing the pressure welding connector according to the above described embodiment.
Figures 11A, 11D, 11E:
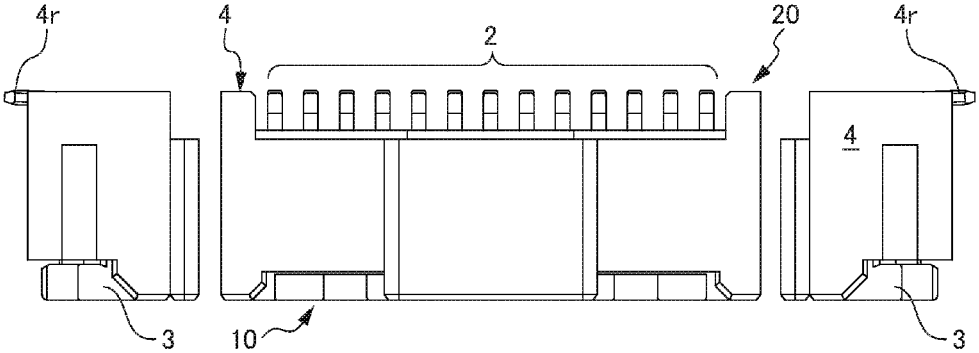
Figure 11B:
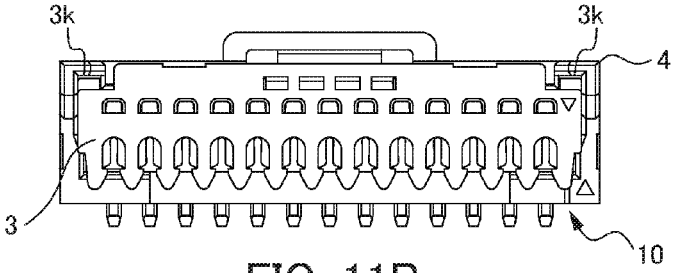
Figure 11F:
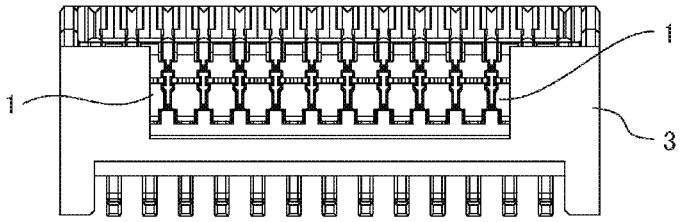

FIGS. 11A to 11F are drawings showing the pressure welding connector according to the above described embodiment, and FIG. 11A is a plan view showing a state in which the pressure welding connector and the mating connector are connected, FIG. 11B is a front view of FIG. 11A, FIG. 11C is a back view of FIG. 11A, FIG. 11D is a right side view of FIG. 11A, FIG. 11E is a left side view of FIG. 11A, and FIG. 11F is a bottom view of FIG. 11A.

(Overall Constitution)

With reference to FIG. 7 to FIG. 11, the pressure welding connector 10 according to one embodiment of the present invention is provided with a rectangular solid-shaped first housing 3 wherein a plurality of pressure welding contacts 1 are disposed. The first housing 3 has insulating properties. The first housing 3 is molded of a synthetic resin consisting of a non-conductive material, which allows obtaining the desired form.

(Constitution of the First Housing)

With reference to FIG. 7 to FIG. 10, the first housing 3 has a first slot 31 and a second slot 32. With reference to FIG. 10, the first slot 31 is hollowed out from one face of the first housing 3. The first slot 31 is capable of accommodating the pressure welding contact 1 (refer to FIG. 2 or FIG. 10). The elastic piece of the pressure welding contact 1 is disposed facing the bottom face of the first slot 31 (refer to FIG. 2).

With reference to FIG. 7 to FIG. 10, the second slot 32 communicates with the first slot 31. The terminal of the electric wire W can be introduced into the second slot 32 from an outer circumferential direction in an insulating covered state. The second slot 32 is narrowed at the opening side in the shape of a letter Q in order to make it difficult for the set electric wire W to detach from the first housing 3.

With reference to FIG. 2 or FIG. 10, the pressure welding contact 1 is disposed at the first slot 31. When the electric wire W is introduced into the second slot 32 from an outer circumferential direction, the pair of pressure welding blades provided at the notched groove 12*d* of the pressure welding piece 12 (refer to FIG. 1) will push aside the insulation covering of the electric wire W, and the core wire of the electric wire W can be electrically connected with the pressure welding contact 1.

With reference to FIG. 3 to FIG. 5, on one end face of the first housing 3, a plurality of holes 3*d* are opened. When the pin contact 2, which is the mating side connector, is inserted into the hole 3*d*, it can connect with the contact connecting portion 1*b* (refer to FIG. 14).

With reference to FIG. 7 to FIG. 11, the first housing 3 has at one end side a header portion 3*h*, and has at the other end side a flange portion 3*f*. The header portion 3*h* can fit into the recess portion 410 of the later described second housing 4. The flange portion 3*f* can partially abut one face of the later described second housing 4.

With reference to FIG. 7 or FIG. 8, the first housing 3 has four quadrangular frustum-shaped engaging protrusions 3*b*. These engaging protrusions 3*b* protrude from one face of the header portion 3*h*. Thus, these engaging protrusions 3*b* can engage and disengage with the hook portion 42*h* of the later described lock arm 42 (refer to FIG. 13 or FIG. 14).

[Constitution of the Mating Side Connector]

Next, the constitution of the mating side connector according to one embodiment of the present invention will be explained.

Figure 12:
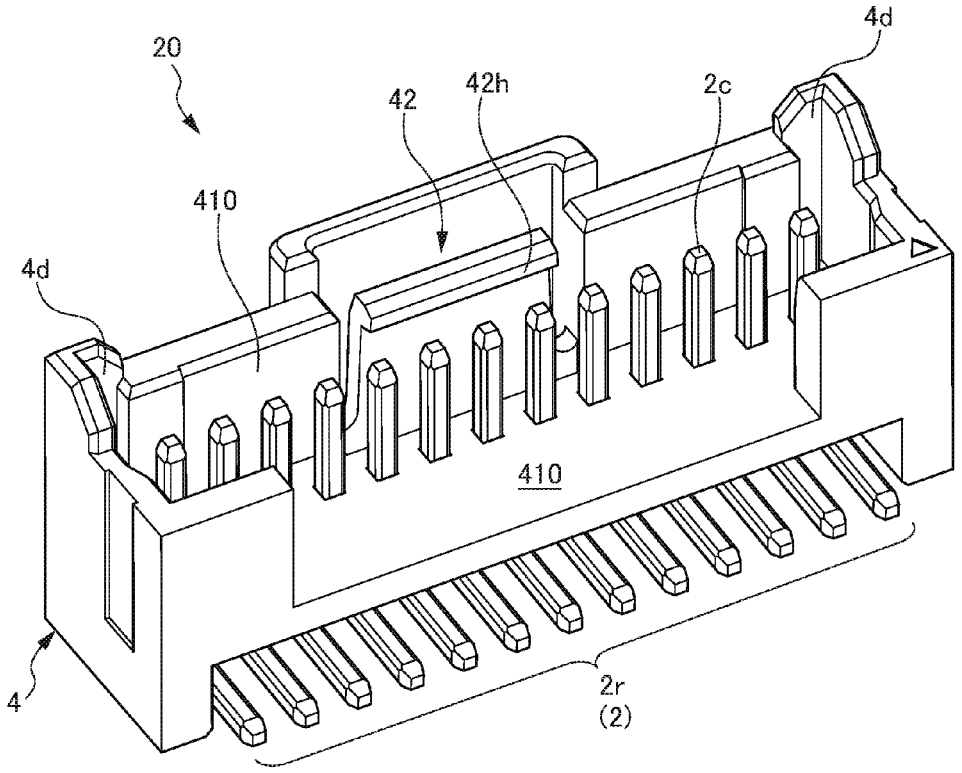
FIG. 12 is an oblique view showing the constitution of the mating side connector, and shows a state viewed from the bottom face side of the mating side connector.

FIG. 12 is an oblique view showing the constitution of the mating side connector, and shows a state viewed from the bottom face side of the mating side connector.

Figure 13:
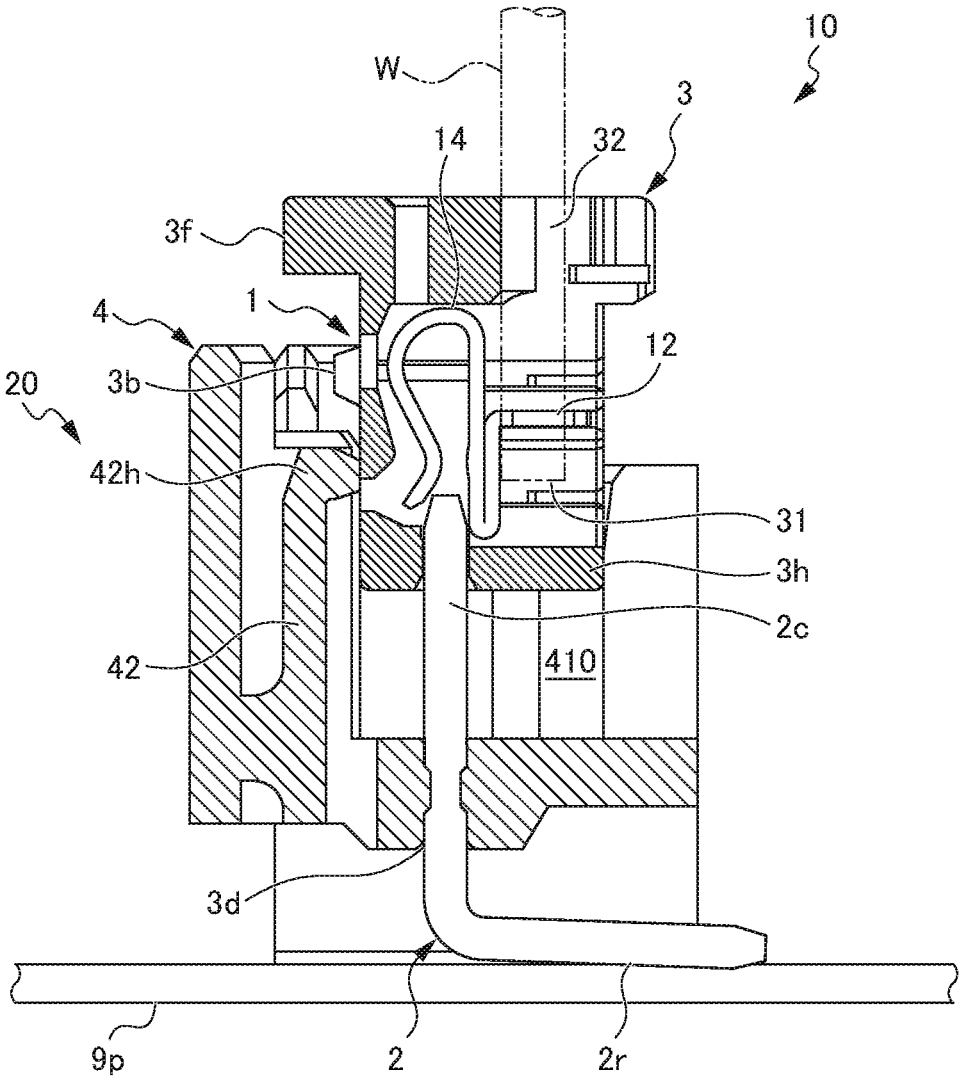
FIG. 13 is a longitudinal section view showing the constitution of the pressure welding connector according to the above described embodiment, and shows a state before the pressure welding connector is inserted into the mating side connector.
Figure 14:
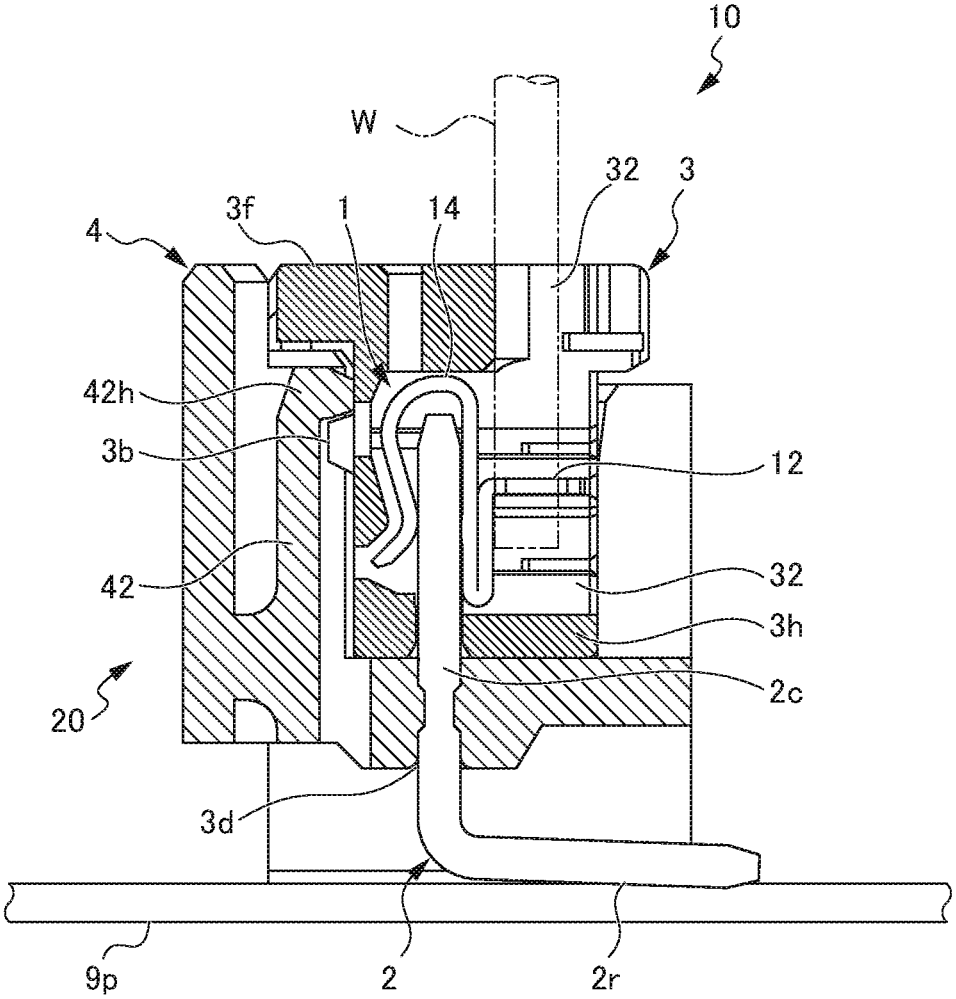
FIG. 14 is a longitudinal section view showing the constitution of the pressure welding connector according to the above described embodiment, and shows a state in which the pressure welding connector has been inserted into the mating side connector.

FIG. 13 is a longitudinal section view showing the constitution of the pressure welding connector according to the above described embodiment, and shows a state before the pressure welding connector is inserted into the mating side connector. FIG. 14 is a longitudinal section view showing the constitution of the pressure welding connector according to the above described embodiment, and shows a state in which the pressure welding connector has been inserted into the mating connector.

(Overall Constitution)

With reference to FIG. 8 to FIG. 14, the mating side connector (below referred to as the "base connector") 20 according to one embodiment of the present invention is provided with a plurality of mating side contacts (below referred to as "pin contacts") and a rectangular solid-shaped second housing 4.

With reference to FIG. 9 to FIG. 12, the second housing 4 has a recess portion 410 where one face has an approximately rectangular-shaped opening. The header portion 3*h* of the first housing 3 can fit into the recess portion 410. For the pin contact 2, the pin-shaped connecting terminals 2*c* are disposed inside the recess portion 410 (refer to FIG. 9 or FIG. 10 and FIG. 12). The contact connecting portion 1*b* of the pressure welding contact 1 can electrically connect with the connecting terminal 2*c*.

With reference to FIG. 9 or FIG. 10 and FIG. 13 or FIG. 14, the second housing 4 has a strip-shaped lock arm 42. The lock arm 42 is provided at a prescribed space from one inner wall of the recess portion 410, and projects from a bottom portion of the recess portion 410 towards the open face of the recess portion 410 and approximately parallel to the one inner wall of the recess portion 410.

Further, with reference to FIG. 10 or FIG. 12, the lock arm 42 is provided at its tip portion with a trapezoidal-shaped hook portion 42*h*. The hook portion 42*h* projects towards a central portion of the recess portion 410.

On the other hand, with reference to FIG. 7 or FIG. 9, the first housing 3 has four quadrangular frustum-shaped engaging protrusions 3*b*. These engaging protrusions 3*b* protrude from one face of the header portion 3*h*. Further, these engaging protrusions 3*b* can engage and disengage with the hook portion 42*h* of the lock arm 42 (refer to FIG. 13 or FIG. 14).

With reference to FIG. 13 and FIG. 14, when the header portion 3*h* is inserted into the recess portion 410, the engaging protrusions 3*b* elastically deform the lock arm 42 and displace the hook portion 42*h*, and the engaging protrusions 3*b* ride over the hook portion 42*h*, and the complete fitting of the base connector 20 and the pressure welding connector 10 can be felt. On the other hand, when pulling out the header portion 3*h* from the recess portion 410, the hook portion 42*h* is displaced, and the pressure welding connector 10 can be readily pulled out from the base connector 20.

(Constitution of the Second Housing)

Next, the constitution of the second housing 4 according to the embodiment will be explained. With reference to FIG. 8 to FIG. 14, the second housing 4 has insulating properties. The second housing 4 is molded of a synthetic resin consisting of a non-conductive material, which allows obtaining the desired form.

With reference to FIG. 9 or FIG. 12, the second housing 4 has a pair of key grooves 4*d*, 4*d*. The pair of key grooves 4*d*, 4*d* communicates with the recess portion 410. Further, the pair of key grooves 4*d*, 4*d* is formed at one inner wall of the recess portion 410. Preferably, the pair of key grooves 4*d*, 4*d* are respectively formed at both ends of one inner wall of the recess portion 410. The pair of key grooves 1*d*, 1*d* slidably guides the later described key 3*k*.

On the other hand, with reference to FIG. 7 or FIG. 9, the first housing 3, at the header portion 3*h*, has a pair of keys 3*k*, 3*k*. The pair of keys 3*k*, 3*k* protrudes from one face of the header portion 3*h*. Further, the pair of keys 3*k*, 3*k* is disposed at a front portion of one face of the header portion 3*h* so as to be able to pass through the above mentioned pair of key grooves 4*d*, 4*d*.

With reference to FIG. 9, the pair of keys 3*k*, 3*k* can fit into the pair of key grooves 4*d*, 4*d*. When the pressure welding connector 10 is to be inserted into the recess portion 410 of the base connector 20 with an incorrect orientation, the pair of keys 3*k*, 3*k* abut one face of the second housing 4, whereby erroneous insertion of the pressure welding connector 10 can be prevented in advance.

(Constitution of the Mating Side Contact)

Next, the constitution of the pin contact 2 according to the embodiment will be explained. With reference to FIG. 9 to FIG. 14, the desired form of the pin contact 2 can be obtained by processing by stamping a conductive metal plate. For the pin contact 2, in consideration of the ease of processing, spring characteristics, conductivity and the like, for example, a copper alloy is preferably used, but it is not limited to copper alloys.

With reference to FIG. 10 or FIG. 12 to FIG. 14, the pin contact 2 has a lead terminal 2*r*. The lead terminal 2*r* is continuous with the connecting terminal 2*c*. By solder joining the lead terminal 2*r* to a pattern (not shown in the drawings) on the surface of the printed circuit board 9*p*, the base connector 20 can be mounted on the printed circuit board 9 (refer to FIG. 8 or FIG. 9).

Further, with reference to FIG. 10 or FIG. 12 to FIG. 14, in order to mount the pin contact 2 onto the surface of the printed circuit board 9*p*, the lead terminal 2*r* is bent at an approximately right angle with respect to the connecting terminal 2*c*.

[Operation of the Pressure Welding Connector]

Next, while explaining the action of the pressure welding connector 10 according to the embodiment, the operation and effects of the pressure welding connector 10 will be explained.

With reference to FIG. 8 or FIG. 9, by inserting the pressure welding connector 10 into the recess portion 410 of the base connector 20 from a direction perpendicular to the printed circuit board 9*p*, the electric wire W can be electrically connected with the pattern of the printed circuit board 9*p* via the pressure welding contact 1 and the pin contact 2 (refer to FIG. 14).

The pressure welding connector 10 and the base connector 20 according to the present embodiment can be referred to as an "electric wire to circuit board connector".

From the state shown in FIG. 13, upon inserting the pressure welding connector 10 into the interior of the recess portion 410, the engaging protrusions 3*b* abut the hook portion 42*h*.

On further inserting the pressure welding connector 10, the abutting face of the engaging protrusions 3*b* and the hook portion 42*h* forms an inclined plane, thus the hook portion 42*h* is displaced towards one inner wall of the recess portion 410 by the elastic deformation of the lock arm 42.

On further inserting the pressure welding connector 10, the engaging protrusions 3*b* ride over the hook portion 42*h* (refer to FIG. 14), the lock arm 42 and the hook portion 42*h* are elastically restored, and and the complete fitting of the pressure welding connector 10 and the base connector 20 can be felt.

On the other hand, from the state shown in FIG. 14, when the pressure welding connector 10 is pulled out from the recess portion 410 of the base connector 20, the abutting face of the engaging protrusions 3*b* and the hook 42*h* forms an inclined plane, and therefore, the hook portion 42*h* is displaced towards one inner wall of the recess portion 410 by the elastic deformation of the hook arm 42. In this way, it is possible to easily pull out the pressure welding connector 10 from the base connector 20 (refer to FIG. 13).

In the base connector 20 according to the embodiment, the lock arm 42, which is the locking mechanism, is disposed inside the recess portion 410, and therefore, there is no concern of other mounted devices mounted on the printed circuit board 9*p* abutting the lock arm, and the locking of the connector becoming unstable.

Further, in the embodiment, in addition to being able to feel the complete fitting of the pressure welding connector 10 and the base connector 20, the pressure welding connector 10 and the base connector 20 are readily attached and detached, and the operability is excellent.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A pressure welding contact provided with an electric wire connecting portion for hard wiring by a pressure welding connection a terminal of an electric wire, and a contact connecting portion which is capable of connecting with a mating side contact, wherein the electric wire connecting portion comprises a strip-shaped first fixing plate on which the terminal of the electric wire can be mounted, and a pressure welding piece continuous from a base end portion of the first fixing plate and rising from one face of the first fixing plate, and having a notched groove, into which a core wire of the electric wire can be introduced from an outer circumferential direction, notched towards the one face of the first fixing plate, the contact connecting portion comprises a strip-shaped second fixing plate which, in a state contacting another face of the first fixing plate from a tip portion of the first fixing plate, extends towards the pressure welding piece, and an elastic piece which is continuous from a base end portion of the second fixing plate, and which turns back towards another face of the second fixing plate from one face of the second fixing plate, and which is provided with a tip portion including a contact point portion in a state which inclines upwards in a direction away from the other face of the second fixing plate towards a tip portion of the second fixing plate, and wherein the pressure welding contact is maintained in a first housing with a hole opened in one end face, into which the mating side contact is insertable from between the tip portion of the second fixing plate and the tip portion of the elastic piece, towards the base end portion of the elastic piece.

2. A pressure welding contact according to claim 1, wherein the pressure welding piece is provided above the second fixing plate between the base end portion and the tip portion of the second fixing plate, and in a perpendicular direction with respect to the one face of the first fixing plate.

3. A pressure welding contact according to claim 1, wherein the pressure welding piece is joined by a notch which is easily separated from a tip edge thereof, to a side portion of a strip-shaped contact carrier, and this contact carrier, is joined to the pressure welding piece in a direction approximately perpendicular with respect to the direction in which the contact carrier extends.

4. A pressure welding connector provided with a rectangular solid-shaped first housing inside which one or more of the pressure welding contacts according to claim 1 are disposed, wherein the first housing comprises a first slot capable of accommodating the pressure welding contact hollowed out from one face of the first housing, where the elastic piece can be disposed to face a bottom face of the first slot, a second slot which communicates with the first slot, into which the terminal of the electric wire can be introduced from an outer circumferential direction in an insulating covered state, and one or more holes, opened on one end face adjoining the one face of the first housing, into which the mating side contact can be inserted towards a space between the tip portion of the second fixing plate and the tip portion of the elastic piece.

5. A pressure welding connector according to claim 4, wherein the mating side connector consists of a pin-shaped connecting terminal, and the mating side connector is provided with a rectangular solid-shaped second housing where one or more of the connecting terminals are disposed inside a recess portion opened at one face, the first housing comprises a header portion which is fittable in the recess portion, formed at one end side, and a flange portion which is partially abuttable with one face of the second housing, formed at another end portion, the second housing comprises a strip-shaped lock arm which is provided at a prescribed space from one inner wall of the recess portion and which projects from a bottom portion of the recess portion towards the open face of the recess portion and approximately parallel to the one inner wall of the recess portion, the lock arm being provided at its tip portion with a trapezoidal-shaped hook portion projecting towards a central portion of the recess portion, and the first housing comprises one or more quadrangular frustum-shaped engaging protrusions which are capable of engaging and disengaging with the hook portion, protruding from one face of the header portion.

6. The pressure welding connector according to claim 5, wherein the mating side connector comprises a lead terminal continuous with the connecting terminal, which can be solder-joined to a printed circuit board.

7. The pressure welding connector according to claim 6, wherein at the mating side connector, the lead terminal is bent at an approximately right angle with respect to the connecting terminal.

* * * * *